US008781142B2

(12) United States Patent
Olafsson et al.

(10) Patent No.: US 8,781,142 B2
(45) Date of Patent: Jul. 15, 2014

(54) SELECTIVE ACOUSTIC ENHANCEMENT OF AMBIENT SOUND

(76) Inventors: Sverrir Olafsson, Newport Beach, CA (US); Ismail I. Eldumiati, Irvine, CA (US)

( * ) Notice: Subject to any disclaimer, the term of this patent is extended or adjusted under 35 U.S.C. 154(b) by 0 days.

(21) Appl. No.: 13/404,844

(22) Filed: Feb. 24, 2012

(65) Prior Publication Data

US 2013/0223660 A1 Aug. 29, 2013

(51) Int. Cl.
*H04R 25/00* (2006.01)
*H04R 3/00* (2006.01)

(52) U.S. Cl.
USPC ..... 381/313; 381/312; 381/317; 381/320; 381/92

(58) Field of Classification Search
CPC .... H04R 25/43; H04R 25/407; H04R 25/505; H04R 2225/41; H04R 2225/43; H04R 3/005; H04R 2410/01; H04R 2430/20; H04S 7/303; H04S 7/304
USPC ..... 381/92, 312–331, 23.1, 56–57, 71.1, 381/73.1, 122, 124
See application file for complete search history.

(56) References Cited

U.S. PATENT DOCUMENTS

| | | | | |
|---|---|---|---|---|
| 2002/0037087 | A1* | 3/2002 | Allegro et al. | 381/317 |
| 2006/0182294 | A1* | 8/2006 | Grasbon et al. | 381/312 |
| 2007/0014419 | A1* | 1/2007 | Steele | 381/92 |
| 2010/0074460 | A1* | 3/2010 | Marzetta | 381/313 |
| 2010/0179806 | A1* | 7/2010 | Zhang et al. | 704/211 |

* cited by examiner

*Primary Examiner* — Matthew Eason
(74) *Attorney, Agent, or Firm* — F. Jason Far-hadian, Esq.; Century IP Group

(57) ABSTRACT

Systems and methods enhancing auditory experience for a user are provided. The method comprises receiving ambient sound by way of one or more microphones positioned about a user; monitoring the user's movements to determine sound signals interesting to the user; processing the received ambient sound based on the user's movements to at least: increase inclusion of the interesting sound signals in a generated audio output; or reduce inclusion of uninteresting sound signals in the generated audio output.

20 Claims, 5 Drawing Sheets

SELECTIVE ACOUSTIC ENHANCEMENT OF AMBIENT SOUND

COPYRIGHT & TRADEMARK NOTICES

A portion of the disclosure of this patent document may contain material subject to copyright protection. The owner has no objection to the facsimile reproduction by any one of the patent document or the patent disclosure, as it appears in the Patent and Trademark Office patent file or records, but otherwise reserves all copyrights whatsoever.

Certain marks referenced herein may be common law or registered trademarks of the applicant, the assignee or third parties affiliated or unaffiliated with the applicant or the assignee. Use of these marks is for providing an enabling disclosure by way of example and shall not be construed to exclusively limit the scope of the disclosed subject matter to material associated with such marks.

TECHNICAL FIELD

The disclosed subject matter relates generally to the technical field of acoustic enhancement and, more particularly, to a hearing enhancement device or method for selectively enhancing ambient sound.

BACKGROUND

Traditional hearing aids help improve auditory perception of patients suffering from hearing loss by performing the simple function of amplifying all ambient sound as received by the hearing aid. Particularly, the audio signal enhancement techniques used in the traditional hearing aids can only operate in a static manner, where a certain configuration or setting is maintained independent of the user's environment or changes in the user's needs.

For example, a user of a hearing aid device may be facing a person nearby and listening to that person during a conversation. The traditional hearing aid can be adjusted to control the volume of voice signals received from the nearby distance. Such setting, however, would not optimize the user's auditory experience if he also wants to listen to music delivered by loudspeakers to the left of the user, or if the user wants to listen to another person located at a further distance behind.

SUMMARY

For purposes of summarizing, certain aspects, advantages, and novel features have been described herein. It is to be understood that not all such advantages may be achieved in accordance with any one particular embodiment. Thus, the disclosed subject matter may be embodied or carried out in a manner that achieves or optimizes one advantage or group of advantages without achieving all advantages as may be taught or suggested herein.

In accordance with one embodiment, a method for enhancing auditory experience for a user is provided. The method comprises receiving ambient sound by way of one or more microphones positioned about a user; monitoring the user's movements to determine sound signals interesting to the user; processing the received ambient sound based on the user's movements to at least: increase inclusion of the interesting sound signals in a generated audio output, or reduce inclusion of uninteresting sound signals in the generated audio output.

In accordance with one or more embodiments, a system comprising one or more logic units is provided. The one or more logic units are configured to perform the functions and operations associated with the above-disclosed methods. In yet another embodiment, a computer program product comprising a computer readable storage medium having a computer readable program is provided. The computer readable program when executed on a computer causes the computer to perform the functions and operations associated with the above-disclosed methods.

One or more of the above-disclosed embodiments in addition to certain alternatives are provided in further detail below with reference to the attached figures. The disclosed subject matter is not, however, limited to any particular embodiment disclosed.

BRIEF DESCRIPTION OF THE DRAWINGS

The disclosed embodiments may be better understood by referring to the figures in the attached drawings, as provided below.

Features, elements, and aspects that are referenced by the same numerals in different figures represent the same, equivalent, or similar features, elements, or aspects, in accordance with one or more embodiments.

DETAILED DESCRIPTION OF EXAMPLE EMBODIMENTS

Figure 1:
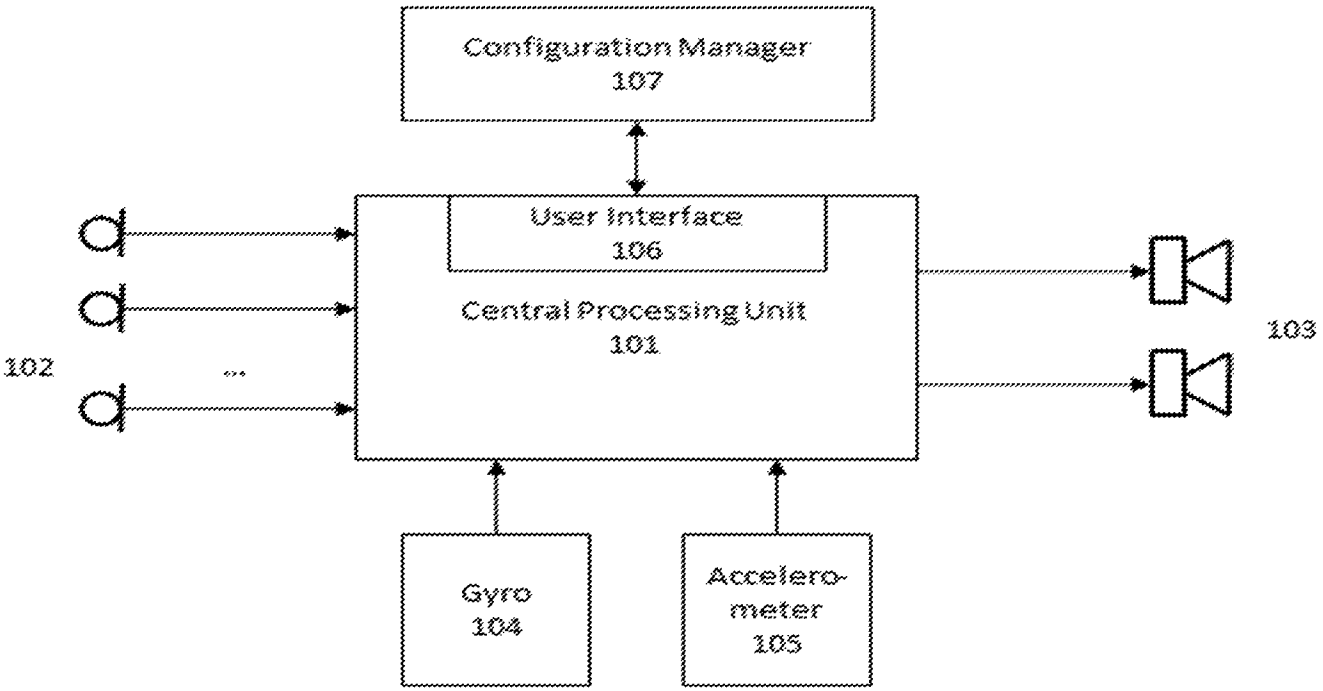
FIG. 1 illustrates an exemplary block diagram of an acoustic enhancement system in accordance with one or more embodiments.

In the following, numerous specific details are set forth to provide a thorough description of various embodiments. Certain embodiments may be practiced without these specific details or with some variations in detail. In some instances, certain features are described in less detail so as not to obscure other aspects. The level of detail associated with each of the elements or features should not be construed to qualify the novelty or importance of one feature over the others.

In accordance with one embodiment, auditory perception is improved by setting the direction of a plurality of microphones in an acoustic enhancement device (e.g., a hearing aid) so that sound signals received from certain directions and angles are filtered, conditioned and amplified in relation to background noise. This process may be transient and adaptive, in addition to a static correction of frequency response and amplification based on the user's hearing status. Depending on implementation, the above process may be achieved as provided in further detail below by way of microphone design, signal processing and placement of one or more speakers for regenerating the received audio.

Accordingly, an audio enhancement device is provided that is configured to phase out sound that is not desirable to the user. Multiple microphones may be configured to receive the ambient sound signals from different directions and use detectors such as electronic gyroscopes and accelerometers to determine the angle of interest for a user. The microphones may be positioned at different locations on the body of the user, for example, front, back, right, left, etc., or in a ring around the neck of the user, depending on implementation.

The more microphones used, the higher the sound resolution and the better the ability to fine-tune the angle of interest. The angle of interest may be used to focus on one or more sound sources. The sound signals received from multiple microphones associated with the angle of interest (i.e., the honed microphones) are amplified while sound signals received from other microphones are either muted or filtered out according to an algorithm as provided in further detail below.

In one implementation, a signal classifier may be added in combination with the above noted components to further filter the sound signals received from the honed microphones according to the algorithm to better filter out noise. For example, the algorithm used may process sounds that are classified as music in a first manner and sounds that are classified as voice in a second manner. The device may also have the capability to tune into sound sources at closer or further distances depending on signals received from the detectors, where the detectors help determine, based on the head or body movements of the user, the directions and the sound sources that are to be selected and processed.

In one embodiment, the above noted selection and processing (i.e., selective sound enhancement) is performed by enhancing the sounds received from a target sound source or direction. The enhancement may be achieved by one or more of noise reduction, noise cancellation, adjustment of signal-to-noise-ratio, filtering or giving more weight to one or more audio signals received from target sound sources or directions. An override feature may be included in certain embodiments to allow the user to turn off the selective sound enhancement feature so the user may listen to the ambient sounds without filtering or special enhancement.

Referring to FIG. 1, an exemplary audio enhancement system is provided. The system comprises microphones 102 for receiving audio signals that are analyzed and processed by at least one processing unit 101 (e.g., a microprocessor or microcontroller). The system further comprises one or more sensors, including one or more orientation or motion detectors (e.g., gyroscope 104, accelerometer 105), that detect head or body movements of the user wearing the hearing aid system that includes the audio enhancement system in an attempt to determine points and angels of interest about the user. Signals generated by the sensors may be fed to the processing unit 101 to help optimize an audio output signal to one or both ears of the user through speakers 103.

Depending on implementation, the microphones 102 may be positioned at different locations on the body of a user. For example, several microphones may be placed in the front, back, right, or left of the body. In one embodiment, the microphones may be wearable or be configured in a necklace type arrangement and worn around the neck, for example. Furthermore, multiple signal inputs may be utilized from microphones that may have varying characteristics, such as different orientations and different degrees of directionality. For example, a unidirectional microphone directed towards a desired signal source may be combined with a multidirectional microphone. By comparing the signals from multiple microphones, the desired signal may be separated out from the background noise more effectively than if only a single or a unidirectional microphone is used.

Figure 2:
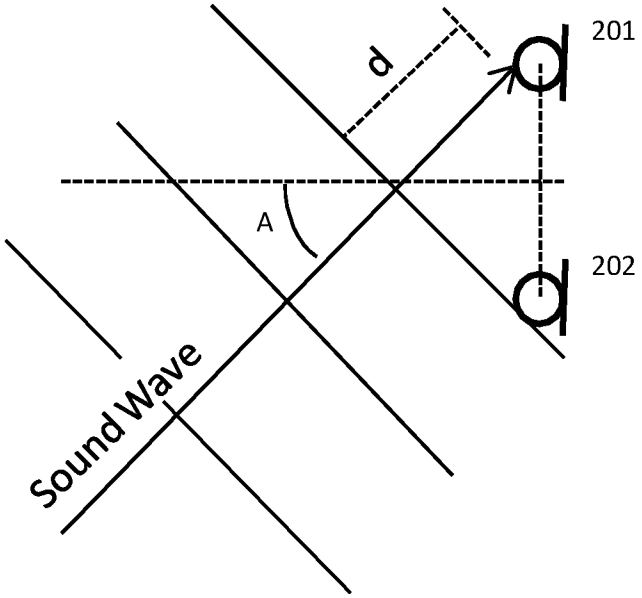
FIG. 2 illustrates two microphones in an exemplary embodiment, where the two microphones are oriented in the same direction to receive a signal arriving at an angle A.

In one example, an algorithm may be used to help filter the sound signals received by microphones 102 depending on the input received from the sensors, desirably taking into account the direction of the signals as the signals arrive. Referring to FIG. 2, microphones 201 and 202 are oriented in the same direction and receive a signal arriving at an angle A to a line drawn orthogonal to a line between the two microphones, for example. As shown, when a sound signal arrives at microphone 202, it will still be at a distance d from microphone 201. Since the signal is travelling at a speed of sound v, the corresponding sound wave will arrive at a time t later, where $t=d/v=\sin(A)/v$, at microphone 201 relative to microphone 202.

In one embodiment, by comparing the phases of the signals detected from the two microphones, a value for angle A can be derived utilizing the relation of the phase $p=f\cdot dt$, where f is the frequency at which the phase is measured such that $A=\sin^{-1}(v\cdot p/f)$. In one implementation, by calculating the phase at multiple frequencies and correlating the measurements with signal power variations, reliable indications of direction may be established. Moreover, the phase response of the microphones may be calibrated to determine the exact direction, using either factory calibration or adaptive beamforming techniques, for example, to compare phase differences across multiple frequencies and correlating with signal power variations.

Referring back to FIG. 1, a processing unit 101 may be used to perform the above-noted processes and other digital signal processing on incoming signals to optimize the auditory experience for different scenarios and environments. Using signals from multiple microphones, the processor unit 101 may apply different signal processing techniques, such as beamforming, to enhance desirable signals and cancel noise or unwanted sound. Processing unit 101 may be mounted on the user's body, either externally or implanted (e.g., in one or more ears). The processing unit 101 may connect to the microphones electronically, by way of wire or wirelessly, for example.

The processing unit 101 may, in one embodiment, analyze the received audio signals to classify the signal as human speech, music, background noise, etc., and evaluate the direction of the signal. Using the sensors discussed earlier, such as motion and position detectors, processor unit 101 may detect the orientation and movements of the user's head or body. By combining the signal classification information with the body movement and orientation, a mode of signal processing may be selected to optimize the auditory perception as provided in further detail herein.

Depending on implementation, the head or body movements and orientation may be specifically learned by the user to enact signal processing algorithms or other acoustic enhancement features for a specific purpose, either by quick movements such as nods, repetitive movements, or by orienting the head in certain ways or directions with respect to the body. Thus, a user may learn to optimize the signal processing by sending commands to the signal processing system by way of various body movements. With time, these commands may become routine such that the user will subconsciously invoke specific commands to improve the signal processing perception.

It is noteworthy that, in accordance with one embodiment, motion and orientation detectors may be used, both to detect the orientation and movement of the head itself as well as in relation to the body. Thus, the processing unit 101 may be able to distinguish between, for example, quick nods of the head and bumps experienced by the whole body while driving in a car, for example. In one embodiment, the processing is configured to be triggered in correspondence with natural user movements to allow for more robust and a less conscious level of effort experience by the user. It is also noted that the output generated as the result of the above provided audio signal processing may be provided to the user by way of speakers 103, which may be mounted in one or more ear canals, for example.

Figure 3:
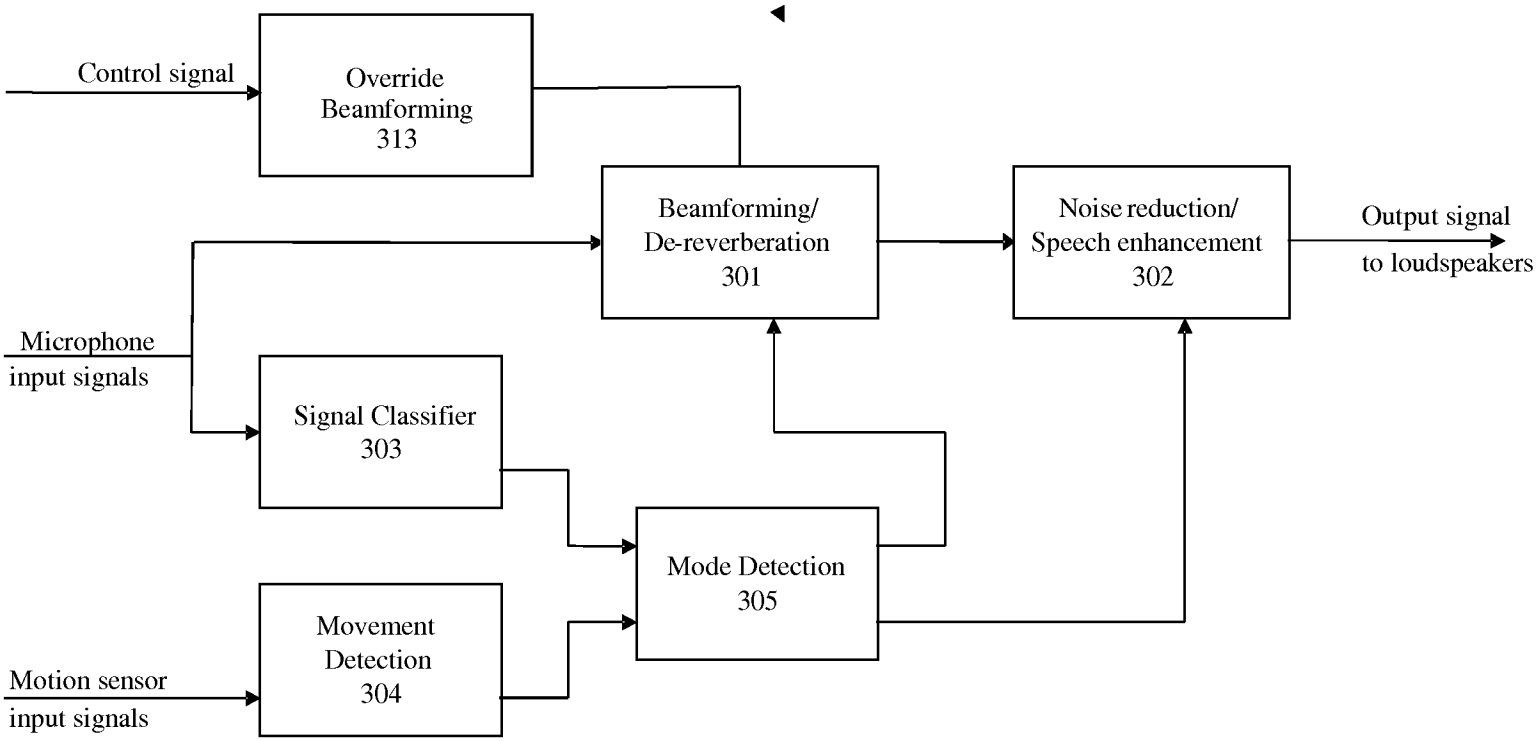
FIG. 3 is an exemplary block diagram of an embodiment, wherein input signals to a plurality of microphones are classified, processed and enhanced in relation to user movement and environment.

Referring to FIG. 3, an exemplary processing unit 101 may comprise a signal classifier 303, a movement detection unit 304, a beamforming/de-reverberation unit 301, a mode detection unit 305, and override beamforming unit 313 and a noise reduction/speech enhancement unit 302. The signal classifier 303 may use one or more algorithms to identify signals as speech, music or other categories. The algorithms may analyze the frequency content along with the power profile, while speech signals alternate between voice signals, characterized by a fundamental pitch frequency and multiple overtones of that frequency, and non-voice signals having a spread-out frequency profile. The algorithms may also include monitoring energy and zero crossings, a point where the sign of a function changes (e.g. from positive to negative), or use entropy measures to discriminate between different sound signals.

Once a signal has been identified by its type, head or body movements or gestures may be interpreted depending on the signal type using movement detection unit 304. By including motion and orientation detectors on the user's head and/or body, the motion of the head relative to the body is tracked. Thus, natural head movements may be detected. For example, a user may direct his head toward a speaker, and then turn his head toward another speaker. Using the directional data and knowledge, a beamforming technique may be enabled and the beamforming angle may be optimized, using beamforming/de-reverberation unit 301.

It is noted, as an example, that when a user has difficulty hearing, the user often turns one ear towards a speaker and lean the head slightly. Detecting such and similar movements, by way of movement detection unit 304, a mode detection unit 305 may be used to identify a particular mode which may indicate a preference for increasing gain or applying more aggressive noise reduction or speech enhancement to sounds received from certain directions or angels. Further, motion and orientation detectors may be used to detect deliberate head or body movements as system commands. For example, forward nods may enable beamforming; slight jerks to one side might increase volume, and slight jerks to the other side might be used as signals to lower the volume. As noted earlier, certain embodiments may be equipped with a feature (e.g., an actuator or a programming interface) that allows the user to send a control signal to an override beamforming unit 313 to disable the functionality of beamforming/de-reverberation unit 301.

Outputs from the signal classifier 303 and movement detection unit 304 may thus be utilized by the mode detection unit 305 to determine how to optimize the auditory perception for a user by way of generating signals that are received as input to a noise reduction/speech enhancement unit 302. When receiving signals from a speaker positioned in front of a user, for example, beamforming/de-reverberation unit 301 may use a beamforming algorithm to apply directionality and noise reduction/speech enhancement unit 302 may use noise reduction algorithms to eliminate background noise. Dereverberation algorithms may also be utilized to reduce reverberation effects, where sound reflects without much attenuation from walls or windows, or when the sound signal contains a sum of multiple components of a signal with a variable delay. In case of music, no enhancement may be performed, for example.

Speech enhancement algorithms may be used, in one implementation, by noise reduction/speech enhancement unit 302 and may be intelligent enough to track a speaker's position and movement, and potentially change the beamforming angle as the speaker moves or the user's head turns. Multiple speakers may be tracked, and when the user is listening to alternating speakers, the beamforming angle may be configured to switch from one to the other. Such algorithms may be aided by correlating the head direction with the calculated angle of interest, as a user would typically look at the speaker being listened to the majority of the time. If a speaker's position is deemed to be stationary, the width of the beamforming may be narrowed to further improve audio signal reception quality. If a signal is believed to be composed of speech, as opposed to music or background noise, certain algorithms may be utilized to help the intelligibility of that speech. Said algorithms may be switched off when the signal is composed more of music or background noise, as to not interfere with the perception of such signals.

In one embodiment, noise cancelling algorithms are utilized in the frequency domain. The time domain signals are then transferred into the frequency domain using Fourier transform techniques, for example. At each frequency, the signal power level is monitored. If the power level stays constant for extended periods, the algorithms determine that the signal is simply background noise and the outgoing signal is attenuated at that frequency. If the power level is varying above the background noise level, the algorithm determines that it is a desired signal and the signal is not attenuated. Note the attenuation may be performed either in the time domain or frequency domain Different algorithms will use different methods to distinguish desired signals from background noise and other algorithms to implement the frequency-dependent gain. In an embodiment, algorithms that apply gain in the time domain may be preferred to limit signal delay.

In accordance with one embodiment, processing unit 101 may include both control processing as well as signal processing. A central processing unit (CPU), for example, that is specially outfitted to perform signal processing functions may be utilized, or a CPU with an accompanying digital signal processor (DSP) device may be used. Depending on the level of processing capability required, cost constraints and power requirements, one type of system may be favored over another. Analog to digital converters (ADC) and digital to analog converters (DAC) may also be integrated with the CPUs to interface with external microphones and loudspeakers, for example.

In one embodiment, the processing unit 101 is outfitted with a user interface 106 which may be connected to a configuration manager 107. The configuration manager 107 may be a hand-held smart phone, a personal computer or a PDA, equipped with embedded applications or apps to help a user modify the resident firmware on the acoustic enhancement device. The configuration manager 107 may, without limitation, perform functions such as firmware upgrade and device calibration. The configuration manager 107 may communicate with the central processor unit 101 via a wired or wireless connection and over a public or private network. In another embodiment, instead of using a configuration manager 107, reconfiguration or upgrade may be performed via directly connecting user interface 106 to a communications network such as the Internet.

In one implementation, the ADCs may be preceded by variable signal gain amplifiers to control the input signal gain. Similarly, DACs may be connected to audio amplifiers to allow direct connection to an external speaker. These amplifiers may be linear of class A, class B or class A/B, or preferably for power sensitive applications of class D or class G. In order to interface these components to various motion detectors and communication components, control bus interfaces, like I2C and SPI, may be used and integrated in the system. To transfer digitized signals between devices, signal transfer protocols, like I2S or PCM, may be utilized.

References in this specification to "an embodiment," "one embodiment," "one or more embodiments" or the like, mean that the particular element, feature, structure or characteristic being described is included in at least one embodiment of the disclosed subject matter. Occurrences of such phrases in this specification should not be particularly construed as referring to the same embodiment, nor should such phrases be interpreted as referring to embodiments that are mutually exclusive with respect to the discussed features or elements.

In different embodiments, the claimed subject matter may be implemented as a combination of both hardware and software elements, or alternatively either entirely in the form of hardware or entirely in the form of software. Further, computing systems and program software disclosed herein may comprise a controlled computing environment that may be presented in terms of hardware components or logic code executed to perform methods and processes that achieve the results contemplated herein. Said methods and processes, when performed by a general purpose computing system or machine, convert the general purpose machine to a specific purpose machine.

Figure 4A:
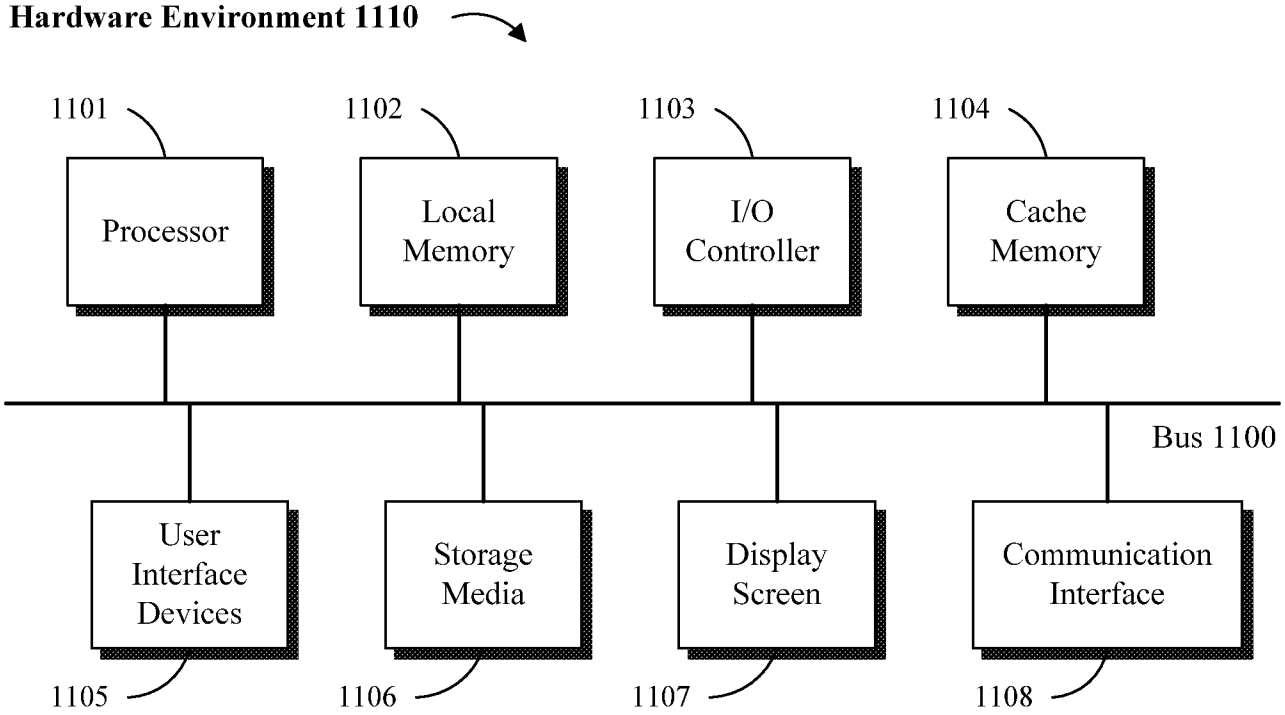
FIGS. 4A and 4B are block diagrams of hardware and software environments in which the disclosed systems and methods may operate, in accordance with one or more embodiments.
Figure 4B:
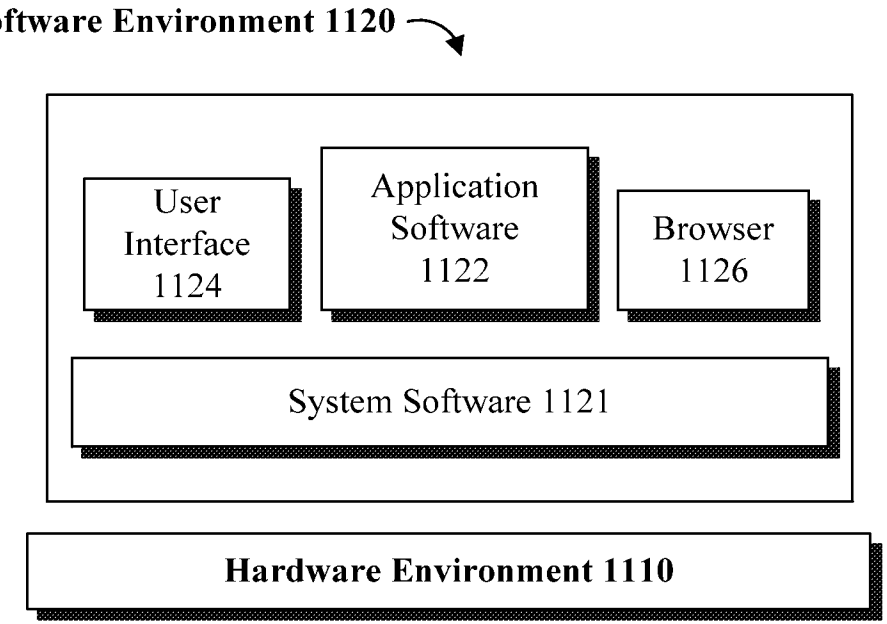

Referring to FIGS. 4A and 4B, a computing system environment in accordance with an exemplary embodiment may be composed of a hardware environment 1110 and a software environment 1120. The hardware environment 1110 may comprise logic units, circuits or other machinery and equipments that provide an execution environment for the components of software environment 1120. In turn, the software environment 1120 may provide the execution instructions, including the underlying operational settings and configurations, for the various components of hardware environment 1110.

Referring to FIG. 4A, the application software and logic code disclosed herein may be implemented in the form of machine readable code executed over one or more computing systems represented by the exemplary hardware environment 1110. As illustrated, hardware environment 1110 may comprise a processor 1101 coupled to one or more storage elements by way of a system bus 1100. The storage elements, for example, may comprise local memory 1102, storage media 1106, cache memory 1104 or other machine-usable or computer readable media. Within the context of this disclosure, a machine usable or computer readable storage medium may include any recordable article that may be utilized to contain, store, communicate, propagate or transport program code.

A computer readable storage medium may be an electronic, magnetic, optical, electromagnetic, infrared, or semiconductor medium, system, apparatus or device. The computer readable storage medium may also be implemented in a propagation medium, without limitation, to the extent that such implementation is deemed statutory subject matter. Examples of a computer readable storage medium may include a semiconductor or solid-state memory, magnetic tape, a removable computer diskette, a random access memory (RAM), a read-only memory (ROM), a rigid magnetic disk, an optical disk, or a carrier wave, where appropriate. Current examples of optical disks include compact disk, read only memory (CD-ROM), compact disk read/write (CD-R/W), digital video disk (DVD), high definition video disk (HD-DVD) or Blue-ray™ disk.

In one embodiment, processor 1101 loads executable code from storage media 1106 to local memory 1102. Cache memory 1104 optimizes processing time by providing temporary storage that helps reduce the number of times code is loaded for execution. One or more user interface devices 1105 (e.g., keyboard, pointing device, etc.) and a display screen 1107 may be coupled to the other elements in the hardware environment 1110 either directly or through an intervening I/O controller 1103, for example. A communication interface unit 1108, such as a network adapter, may be provided to enable the hardware environment 1110 to communicate with local or remotely located computing systems, printers and storage devices via intervening private or public networks (e.g., the Internet). Wired or wireless modems and Ethernet cards are a few of the exemplary types of network adapters.

It is noteworthy that hardware environment 1110, in certain implementations, may not include some or all the above components, or may comprise additional components to provide supplemental functionality or utility. Depending on the contemplated use and configuration, hardware environment 1110 may be a machine such as a desktop or a laptop computer, or other computing device optionally embodied in an embedded system such as a set-top box, a personal digital assistant (PDA), a personal media player, a mobile communication unit (e.g., a wireless phone), or other similar hardware platforms that have information processing or data storage capabilities.

In some embodiments, communication interface 1108 acts as a data communication port to provide means of communication with one or more computing systems by sending and receiving digital, electrical, electromagnetic or optical signals that carry analog or digital data streams representing various types of information, including program code. The communication may be established by way of a local or a remote network, or alternatively by way of transmission over the air or other medium, including without limitation propagation over a carrier wave.

As provided here, the disclosed software elements that are executed on the illustrated hardware elements are defined according to logical or functional relationships that are exemplary in nature. It should be noted, however, that the respective methods that are implemented by way of said exemplary software elements may be also encoded in said hardware elements by way of configured and programmed processors, application specific integrated circuits (ASICs), field programmable gate arrays (FPGAs) and digital signal processors (DSPs), for example.

Referring to FIG. 4B, software environment 1120 may be generally divided into two classes comprising system software 1121 and application software 1122 as executed on one or more hardware environments 1110. In one embodiment, the methods and processes disclosed here may be implemented as system software 1121, application software 1122, or a combination thereof. System software 1121 may comprise control programs, such as an operating system (OS) or an information management system, that instruct one or more processors 1101 (e.g., microcontrollers) in the hardware environment 1110 on how to function and process information. Application software 1122 may comprise but is not limited to program code, data structures, firmware, resident software, microcode or any other form of information or routine that may be read, analyzed or executed by a processor 1101.

In other words, application software 1122 may be implemented as program code embedded in a computer program product in form of a machine-usable or computer readable storage medium that provides program code for use by, or in connection with, a machine, a computer or any instruction execution system. Moreover, application software 1122 may comprise one or more computer programs that are executed on top of system software 1121 after being loaded from storage media 1106 into local memory 1102. In a client-server architecture, application software 1122 may comprise client software and server software. For example, in one embodiment, client software may be executed on a client computing system that is distinct and separable from a server computing system on which server software is executed.

Software environment 1120 may also comprise browser software 1126 for accessing data available over local or remote computing networks. Further, software environment 1120 may comprise a user interface 1124 (e.g., a graphical user interface (GUI)) for receiving user commands and data. It is worthy to repeat that the hardware and software architectures and environments described above are for purposes of example. As such, one or more embodiments may be implemented over any type of system architecture, functional or logical platform or processing environment.

It should also be understood that the logic code, programs, modules, processes, methods and the order in which the respective processes of each method are performed are purely exemplary. Depending on implementation, the processes or any underlying sub-processes and methods may be performed in any order or concurrently, unless indicated otherwise in the present disclosure. Further, unless stated otherwise with specificity, the definition of logic code within the context of this disclosure is not related or limited to any particular programming language, and may comprise one or more modules that may be executed on one or more processors in distributed, non-distributed, single or multiprocessing environments.

As will be appreciated by one skilled in the art, a software embodiment may include firmware, resident software, microcode, etc. Certain components including software or hardware or combining software and hardware aspects may generally be referred to herein as a "circuit," "module" or "system." Furthermore, the subject matter disclosed may be implemented as a computer program product embodied in one or more computer readable storage medium(s) having computer readable program code embodied thereon. Any combination of one or more computer readable storage medium(s) may be utilized. The computer readable storage medium may be a computer readable signal medium or a computer readable storage medium. A computer readable storage medium may be, for example, but not limited to, an electronic, magnetic, optical, electromagnetic, infrared, or semiconductor system, apparatus, or device, or any suitable combination of the foregoing.

In the context of this document, a computer readable storage medium may be any tangible medium that can contain, or store a program for use by or in connection with an instruction execution system, apparatus, or device. A computer readable signal medium may include a propagated data signal with computer readable program code embodied therein, for example, in baseband or as part of a carrier wave. Such a propagated signal may take any of a variety of forms, including, but not limited to, electro-magnetic, optical, or any suitable combination thereof. A computer readable signal medium may be any computer readable medium that is not a computer readable storage medium and that can communicate, propagate, or transport a program for use by or in connection with an instruction execution system, apparatus, or device.

Program code embodied on a computer readable storage medium may be transmitted using any appropriate medium, including but not limited to wireless, wireline, optical fiber cable, RF, etc., or any suitable combination of the foregoing. Computer program code for carrying out the disclosed operations may be written in any combination of one or more programming languages, including an object oriented programming language such as Java, Smalltalk, C++ or the like and conventional procedural programming languages, such as the "C" programming language or similar programming languages.

The program code may execute entirely on the user's computer, partly on the user's computer, as a stand-alone software package, partly on the user's computer and partly on a remote computer or entirely on the remote computer or server. In the latter scenario, the remote computer may be connected to the user's computer through any type of network, including a local area network (LAN) or a wide area network (WAN), or the connection may be made to an external computer (for example, through the Internet using an Internet Service Provider).

Certain embodiments are disclosed with reference to flowchart illustrations or block diagrams of methods, apparatus (systems) and computer program products according to embodiments. It will be understood that each block of the flowchart illustrations or block diagrams, and combinations of blocks in the flowchart illustrations and/or block diagrams, can be implemented by computer program instructions. These computer program instructions may be provided to a processor of a general purpose computer, a special purpose machinery, or other programmable data processing apparatus to produce a machine, such that the instructions, which execute via the processor of the computer or other programmable data processing apparatus, create means for implementing the functions or acts specified in the flowchart or block diagram block or blocks.

These computer program instructions may also be stored in a computer readable storage medium that can direct a computer, other programmable data processing apparatus, or other devices to function in a particular manner, such that the instructions stored in the computer readable storage medium produce an article of manufacture including instructions which implement the function or act specified in the flowchart or block diagram block or blocks.

The computer program instructions may also be loaded onto a computer, other programmable data processing apparatus, or other devices to cause a series of operational steps to be performed on the computer, other programmable apparatus or other devices to produce a computer or machine implemented process such that the instructions which execute on the computer or other programmable apparatus provide processes for implementing the functions or acts specified in the flowchart or block diagram block or blocks.

The flowchart and block diagrams in the figures illustrate the architecture, functionality, and operation of possible implementations of systems, methods and computer program products according to various embodiments. In this regard, each block in the flowchart or block diagrams may represent a module, segment, or portion of code, which comprises one or more executable instructions for implementing the specified logical functions. It should also be noted that, in some alternative implementations, the functions noted in the block may occur in any order or out of the order noted in the figures.

For example, two blocks shown in succession may, in fact, be executed substantially concurrently, or the blocks may sometimes be executed in the reverse order, depending upon the functionality involved. It will also be noted that each block of the block diagrams or flowchart illustration, and combinations of blocks in the block diagrams or flowchart illustration, may be implemented by special purpose hardware-based systems that perform the specified functions or acts, or combinations of special purpose hardware and computer instructions.

The claimed subject matter has been provided here with reference to one or more features or embodiments. Those skilled in the art will recognize and appreciate that, despite of the detailed nature of the exemplary embodiments provided here, changes and modifications may be applied to said embodiments without limiting or departing from the generally intended scope. These and various other adaptations and combinations of the embodiments provided here are within the scope of the disclosed subject matter as defined by the claims and their full set of equivalents.

What is claimed is:

1. A method for improving auditory experience for a user, the method comprising:

receiving ambient sound by way of one or more microphones positioned about a user;

comparing phases of two or more microphone inputs to determine one or more directions from which the sound signals are received;

based on power and spectral content of a received sound signal, identifying the sound signal as belonging to a first type from among a plurality of types comprising at least one of speech, music or noise;

monitoring the user's actions by way of sensing mechanisms with which the user interacts to determine the user's preference for a first type of sound signal received from at least a first direction;

based on analyzing the one or more sound signals direction and type in view of the user's interactions when receiving the one or more sound signals, determining that the first type of sound signal received from the at least first direction is interesting to the user, even if the user is not facing the at least first direction; and adaptively processing the sounds signals to enhance the interesting sound signals in a generated audio output by way of beamforming and to suppress the uninteresting sound signals in the generated audio output by way of filtering or noise cancelling.

2. The method of claim 1, further comprising providing the generated audio output to the user.

3. The method of claim 1, wherein the one or more microphones are strategically positioned on or about the user to receive the ambient sound from different directions.

4. The method of claim 1 wherein one or more gyroscopes positioned on or about the user are utilized to monitor the user's movements.

5. The method of claim 1 wherein one or more accelerometers positioned on or about the user are utilized to monitor the user's movements.

6. The method of claim 3 wherein at least a first algorithm is utilized to classify a plurality of sound signals in the received ambient sound to identify whether a sound signal is associated with speech, music or other sound category.

7. The method of claim 1 wherein said monitoring includes monitoring of the user's movements for at least one of a specific change in orientation of user's head as learned by the user, nodding of the head or other repetitive movements of the user's head or body.

8. The method of claim 7 wherein a sound signal determined to be interesting to the user is enhanced by way of at least one of amplifying the interesting sound signal, filtering out the uninteresting sound signals, applying noise cancellation or adjusting sound intake from a direction associated with the interesting or uninteresting sound signals.

9. The method of claim 1 wherein sound processing is performed by way of software running on a processor embedded in a hearing aid device.

10. The method of claim 9 wherein the software is updated by way of communication between the hearing aid device and a secondary device capable of loading data to update the software.

11. The method of claim 10 wherein the secondary device is at least one of a computer, a personal data assistance (PDA) or a cellular phone.

12. The method of claim 2 wherein the audio output is provided to the user by way of at least one speaker positioned on or about the user.

13. The method of claim 12 wherein the audio output is provided to the speaker wirelessly.

14. The method of claim 9 wherein the hearing aid device can be calibrated remotely either on demand by the user or without user intervention through periodic calibration routines.

15. A system for improving auditory experience for a user, the system comprising:

one or more microphones positioned about a user for receiving ambient sound;

at least one processor for comparing phases of two or more microphone inputs to determine one or more directions from which the sound signals are received;

a logic unit that based on power and spectral content of a received sound signal, identifies the sound signal as belonging to a first type from among a plurality of types comprising at least one of speech, music or noise;

sensing mechanisms for monitoring the user's actions to determine the user's preference for a first type of sound signal received from at least a first direction;

a logic unit that based on analyzing the one or more sound signals' direction and type in view of the user's interactions when receiving the one or more sound signals, determines that the first type of sound signal received from the at least first direction is interesting to the user, even if the user is not facing the at least first direction; and a logic unit for adaptively processing the sounds signals to enhance the interesting sound signals in a generated audio output by way of beamforming and to suppress the uninteresting sound signals in the generated audio output by way of filtering or noise cancelling.

16. The system of claim 15, further comprising one or more speakers for providing the generated audio output to the user.

17. The system of claim 15, wherein the one or more microphones are strategically positioned on or about the user to receive the ambient sound from different directions.

18. The system of claim 15, wherein one or more gyroscopes positioned on or about the user are utilized to monitor the user's movements.

19. The system of claim 15, wherein one or more accelerometers positioned on or about the user are utilized to monitor the user's movements.

20. The system of claim 17, wherein at least a first algorithm is utilized to classify a plurality of sound signals in the received ambient sound to identify whether a sound signal is associated with speech, music or other sound category.

* * * * *